United States Patent [19]

Akiyama

[11] 4,121,488

[45] Oct. 24, 1978

[54] STEP-ON TYPE TONE SCALE PLAY DEVICE

[75] Inventor: Kakunosuke Akiyama, Musashino, Japan

[73] Assignee: Nep Company, Ltd., Tokyo, Japan

[21] Appl. No.: 771,663

[22] Filed: Feb. 24, 1977

[30] Foreign Application Priority Data

Mar. 8, 1976 [JP] Japan ..... 51-27256[U]
May 22, 1976 [JP] Japan ..... 51-65773[U]

[51] Int. Cl.[2] ..... G10H 1/00; G10H 5/06

[52] U.S. Cl. ..... 84/1.01; 84/477 R; 84/478; 84/DIG. 7; 84/DIG. 8; 84/DIG. 25; 200/86.5; 340/365 A

[58] Field of Search ..... 84/1.01, 1.24, 470, 84/477 R, 478, DIG. 7, DIG. 8, DIG. 25; 200/85 R, 86.5; 340/365 R, 365 A

[56] References Cited

U.S. PATENT DOCUMENTS

| | | | |
|---|---|---|---|
| 3,749,810 | 7/1973 | Dow | 84/1.24 |
| 3,775,546 | 11/1973 | Honegger | 84/1.01 |
| 3,922,944 | 12/1975 | Kurosaki et al. | 84/1.01 |

*Primary Examiner*—Stanley J. Witkowski
*Attorney, Agent, or Firm*—Biebel, French & Nauman

[57] ABSTRACT

A step-on type tone scale play device has a flexible mat within which is arranged a plurality of flexible switch elements in accordance with a tone scale and is adapted to produce corresponding music sounds when marks configured on the surface of a mat to indicate the position of each switch element are stepped on.

The device is very easy to keep and carry, and convenient to display or perform as compared to the conventional device, as the mat is light and capable of folding or rolling into a compact form.

7 Claims, 12 Drawing Figures

FIG. 1
PRIOR ART
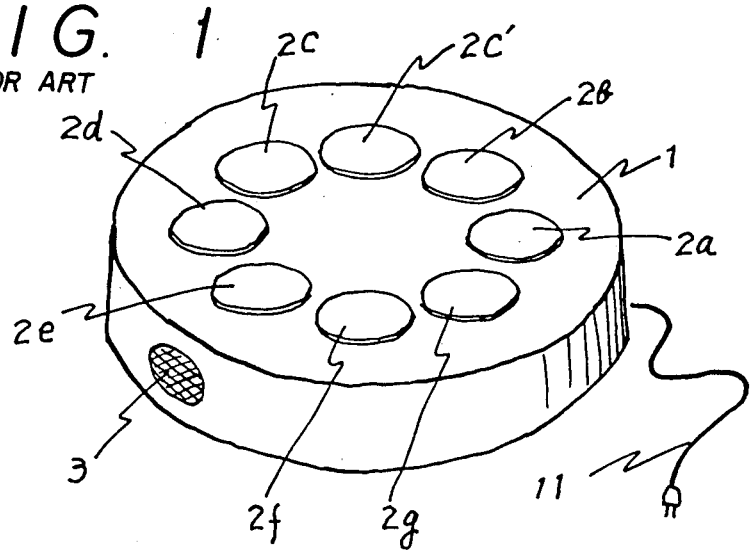
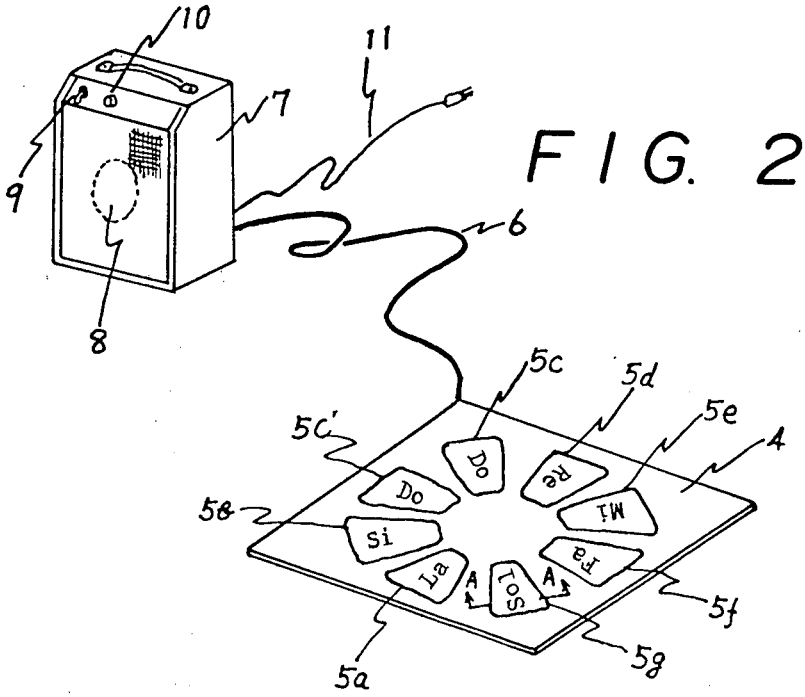
FIG. 2

STEP-ON TYPE TONE SCALE PLAY DEVICE

BACKGROUND OF THE INVENTION

The present invention relates to music play devices suitable for auditory training of children, and more specifically to improvements in a step-on type tone scale play device.

Conventionally, a step-on type tone scale play device such as shown in FIG. 1, exists for children, wherein step plates 2c – 2c' are arranged in accordance with a tone scale and are provided on a somewhat wide, high and rigid platform 1, and by stepping on plates 2c – 2c', corresponding music sounds are produced from a speaker 3.

However, the device of FIG. 1 is not widely used because of its bulky and heavy platform. It is inconvenient to keep or carry, and has the disadvantages of being difficult to display or demonstrate for sale. It also has a high production cost.

SUMMARY OF THE INVENTION

Accordingly, an object of the present invention is to provide a practical step-on type tone scale play device, in which, such disadvantages as set forth above are removed.

The above object may be readily attained in a device comprising a flexible mat of a given width, within which is arranged a plurality of switch elements in accordance with a tone scale, each having a pair of oppositely disposed flexible conductive sheets with a flexible and resilient insulating cushion interposed therebetween, the insulating cushion has a plurality of holes, each receiving a conductive member, to form contact points between the conductive sheets. The flexible mat has marks on the surface thereof to indicate positions of said switch elements, and each of said switch elements are connected to control an electronic circuit and is adapted to close the contact points and produce a musical sound by stepping on a corresponding mark on said mat.

Thus the entire part to be stepped on by foot is composed of flexible material, so that, even when many people walk on the mat their weight is supported by the floor and the mat itself is not damaged.

Further, the device is easy to keep or carry, as the mat is light and capable of folding or rolling into a compact form. It can be also manufactured economically.

In one embodiment of the present invention, at least one of the flexible conductive sheets is provided with a plurality of projections which are received within the holes of the flexible insulating cushion to form contact points.

In another embodiment, the flexible conductive sheets are made flat and a piece of electric conductor is received within each of the holes of said flexible insulating cushion and forms a contact point. In this case, the mat can be fabricated more easily.

These and other objects and advantages of the present invention will be apparent from the following description, the accompanying drawings and the appended claims.

BRIEF DESCRIPTION OF THE DRAWINGS

In the drawings:

FIG. 1 is a perspective view of the conventional step-on type tone scale play device, FIG. 2 is a perspective view of the overall appearance of one embodiment of the present invention.

DESCRIPTION OF THE PREFERRED EMBODIMENTS

Figure 3:
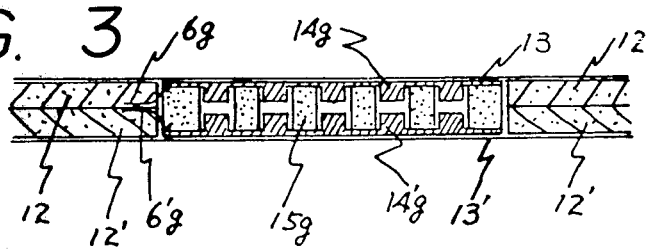
FIG. 3 is an enlarged sectional view taken along line A—A of FIG. 2.

Referring now to the drawings, a step-on type tone scale play device shown in FIG. 2 comprises a mat 4 covered with flexible sheets such as canvas. On the surface thereof are figured marks 5c – 5c' indicating musical tones in accordance with a tone scale. Switch elements are arranged within the mat under each mark, and each of them is connected to an electronic circuit within a main box 7 by a multicore cable 6. In FIG. 2, 8 is a speaker, 9 is a power switch, 10 is a volume controller and 11 is the power cord.

When children, for instance, step on each mark 5c – 5c', a corresponding music sound is produced from the speaker 8, and by stepping on the different marks one after another, a melody can be played. Thus an excellent play device for children is obtained, as the auditory sense is cultured naturally by the device, accompanied by some suitable physical exercises.

Figure 12:
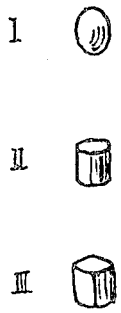
FIG. 12 is a perspective view, illustrating several forms of the electric conductor.

In FIG. 3, 12 and 12' are flexible core materials of the mat 4, such as felt, and 13 and 13' are the cover sheets.

Figure 4:
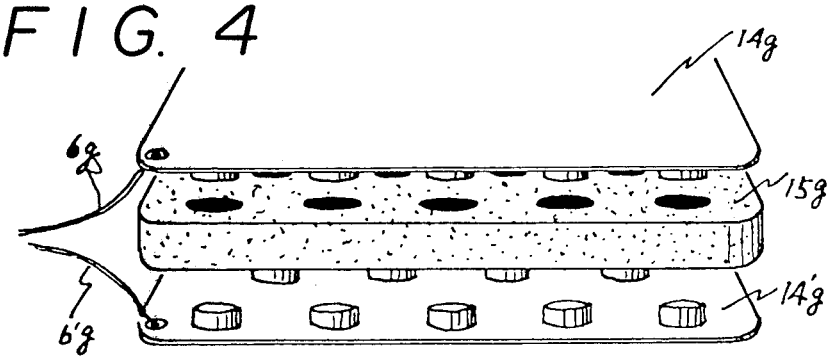
FIG. 4 is a fragmental perspective view of the switch element shown in FIG. 3, showing the parts exploded.

14g and 14'g are a pair of flexible conductive sheets of the switch element arranged in the mat, each having projections on the opposed surface thereof, as best shown in FIG. 4. The conductive sheets 14g and 14'g are overlapped, with a spongy insulating cushion 15g interposed therebetween, whereby the projections of both sheets 14g and 14'g are received in corresponding holes provided in cushion 15g.

Electro-conductive rubber may be used for the conductive sheets 14g and 14'g, and sponge rubber, foamed polyurethane or similar flexible and resilient material may be used preferably for the insulating cushion 15g.

The insulating cushion 15g should be thicker than the height of the projections in order to form contact gaps between the projection. Provision of more than several projections may be required for reliability. Preferably, the conductive sheets 14g, 14'g and insulating cushion 15g are fixed in place such as by the use of adhesive or glue.

Figure 5:
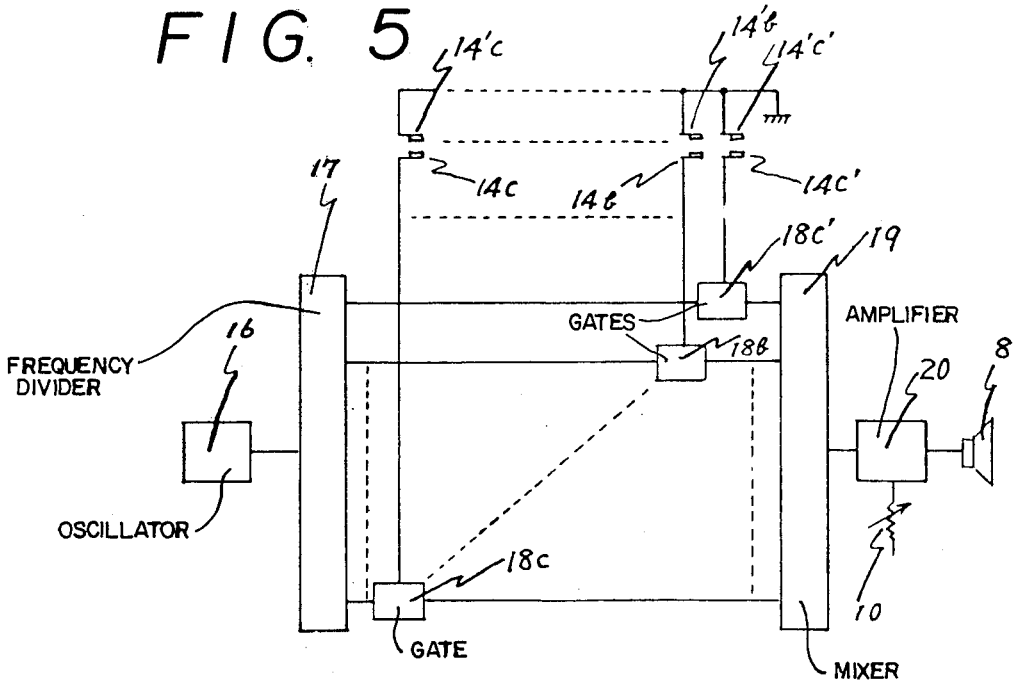
FIG. 5 is an example of an electric diagram of the present invention.

When the sheet 14g is stepped on, the cushion 15g is compressed and the opposite projections of sheets 14g and 14'g contact within the holes of the cushion and form the switching contact 14g which is located between switches 14c and 14c' of FIG. 5. The switching contacts 14g can control the electronic circuit in the main box 7, since the sheets 14*g* and 14′*g* are connected thereto by means of the multicore cable 16, ends of which are shown and designated 6*g* and 6′*g* respectively.

FIG. 5 shows an example of an electric diagram of the present invention, in which an oscillating circuit 16 oscillates at several hundred KHz, and signals of one octave of music sounds corresponding to C major $C_4$ – $C_5$ are obtained by a frequency dividing circuit 17, and each of the signals is introduced to gate circuits 18*c* – 18*c*′. Each gate circuit 18 is connected to a corresponding switch element 14′*c*/14*c* – 14′*c*′/14*c*′ under marks 5*c* – 5*c*′ in FIG. 2, respectively, so as to pass the signal only when the corresponding switch is closed. Passed signals are introduced to a mixing circuit 19, and its output is amplified suitably by amplifier 20 and volume controller 10 and produces sounds from the speaker 8.

Figure 6:
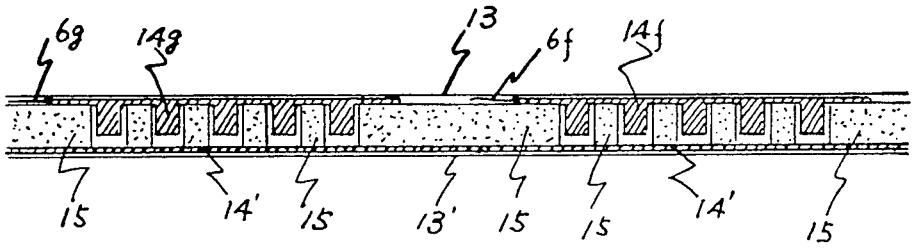
FIG. 6 is a fragmentary sectional view of another example of the mat.

FIG. 6 shows another example of the mat in which the cushion 15 and core material 12, which is shown in FIG. 3, are made in one piece, and projections are provided only on the upper conductive sheets 14*c* – 14*c*′, each received within holes provided correspondingly in the cushion 15. Further, the lower conductive sheets are made in one flat sheet 14′ extending all over the mat. In this case, the thickness of the cushion 15 should be also thicker than the height of the projections to form contact gaps within the holes.

Figure 7:
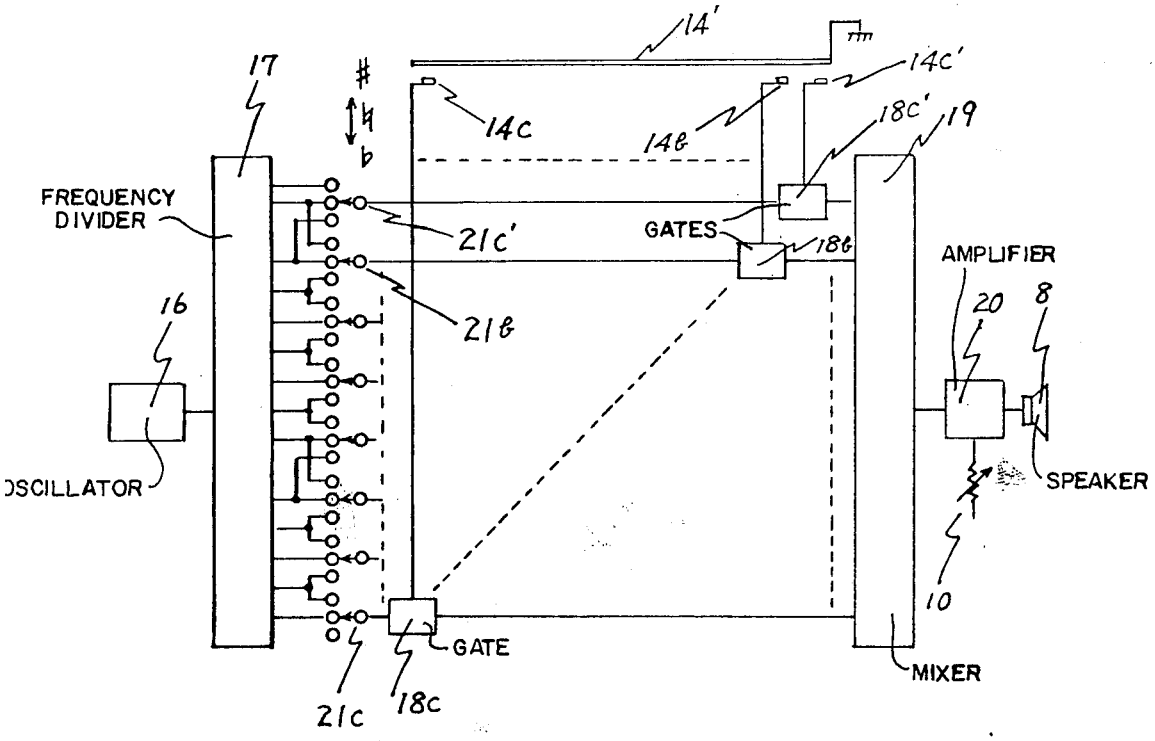
FIG. 7 is another example of an electric diagram.

FIG. 7 shows another example of an electric diagram, illustrating the wiring to be used with the mat shown in FIG. 6, as well as the use of half tone changing switches 21*c* – 21*c*′.

It will be understood that only melodies without sharp or flat signs in the staff, such as of C major or A minor can be played with the circuit shown in FIG. 5, but according to the circuit shown in FIG. 7, all melodies may be played, although the number of outputs of the dividing circuit 17 may increase due to including half tones.

Figure 8:
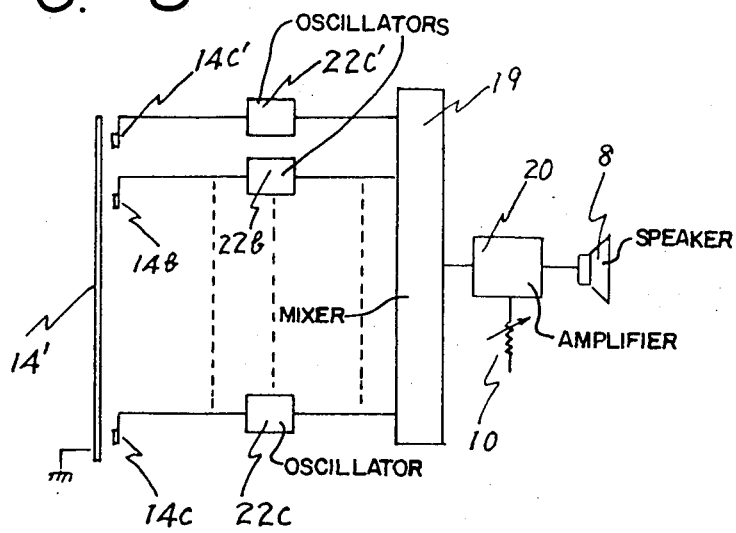
FIG. 8 is a further example of an electric diagram.

FIG. 8 shows a further example of an electric diagram in which 22*c* – 22*c*′ indicate separate audio-frequency oscillating circuits, each of which is controlled by the corresponding switch element and which performs in a manner similar to the other examples.

Figure 9:
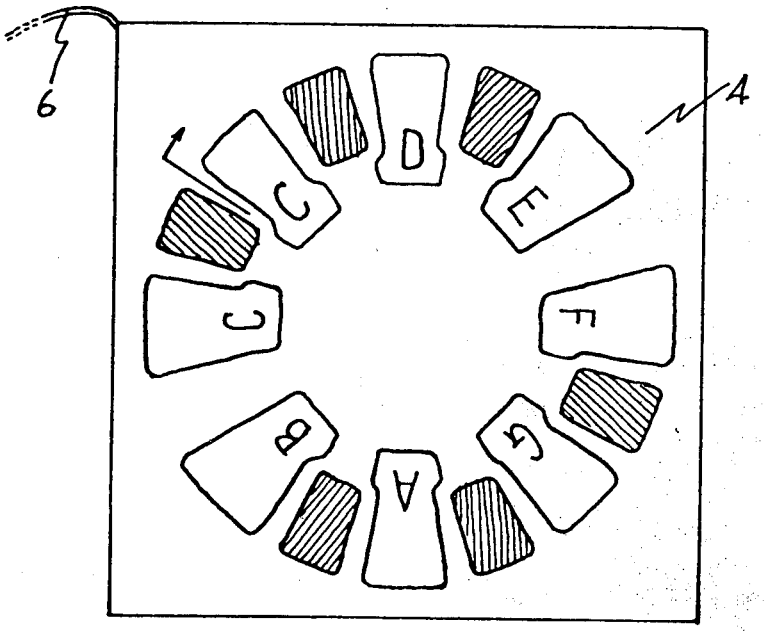
FIG. 9 is a plan view of another example of musical tone indications on the mat.

Mat 4 may be further provided with half tone indications as shown in FIG. 9 like the black keys of a piano, each having a switch element thereunder. In this case, all melodies may be played without need of half tone changing switches, such as shown in FIG. 7.

Indication of musical tone may be made not only by a letter, but also by a picture, which will be more familiar to the children. For instance, a picture of a doughnut may be used for "Do", and so on. Although only one octave of the tones is shown in the drawing, it may be required to increase this by one or more tones.

Figure 10:
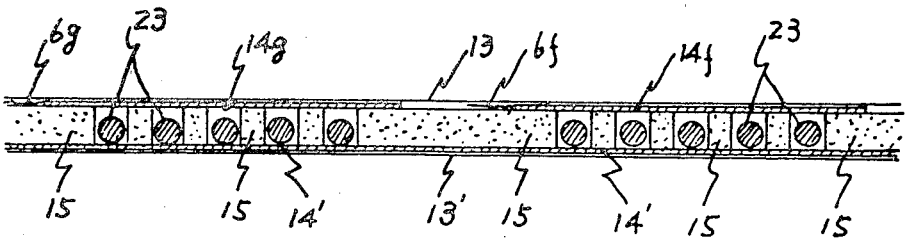
FIG. 10 is a fragmentary sectional view of the mat of another embodiment of the present invention.
Figure 11:
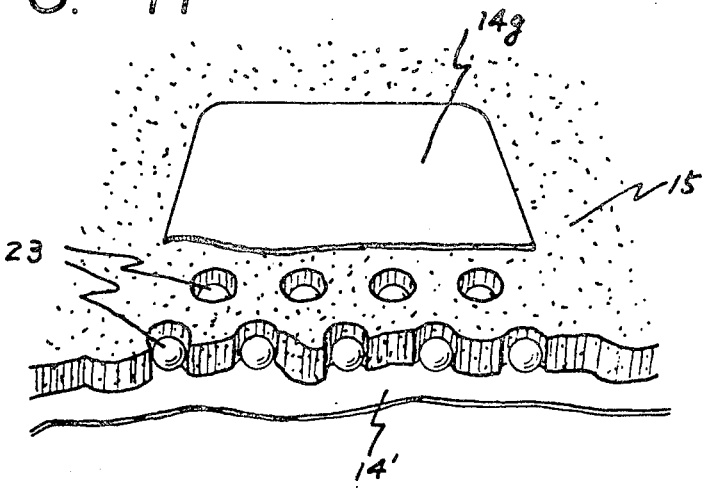
FIG. 11 is a fragmental perspective view of the mat shown in FIG. 10, showing the parts exploded and partly broken away.

FIG. 10 and FIG. 11 show another embodiment of the present invention in which the upper conductive sheets 14*c* – 14*c*′ are made flat, and a conductive ball 23 is received within each corresponding hole provided in the insulating cushion 15.

The diameter of the balls 23 should be smaller than the thickness of the cushion 15 to form contact gaps between the ball and the conductive sheets. Inexpensive material, such as electro-conductive rubber, metal, plated plastics, etc., may be used for the ball 23.

The conductive sheets 14′ and 14*c* – 14*c*′ should be fixed in place, such as by the use of adhesive or glue to seal the balls within the holes and to prevent the balls from coming out of the holes, and also to prevent the sheets moving from the place where the musical tone indication is configured on the surface of the mat.

By stepping on a switch element, the conductive sheets 14*c* – 14*c*′ and 14′ communicate with each other through the conductive balls 23, and perform similarly as in the other examples. FIG. 12 shows other examples of electric conductor elements which may be used instead of balls.

Though not shown in the drawing, quilting may be suitably applied on the cover sheets 13 and 13′.

It will be seen from the above description that the device of the present invention is very easy to handle and can be manufactured economically. The mat is light and capable of being folded or rolled into a compact form. And, as the mat is covered with cover sheets, malfunction of the switch elements by the accumulation of dust may be prevented.

By using the mat shown in FIGS. 10 and 11, the device may be manufactured more easily and economically, as a continuous long sheet can be used for the mat, and such precise alignment of the projections and holes as required for the embodiment shown in FIGS. 3, 4 and 6 is not required.

What is claimed is:

1. A step-on type tone scale play device comprising a flexible mat, a plurality of switch elements arranged on said mat and representing the notes of a musical scale, said switch elements including oppositely disposed flexible conductive sheets forming at least a part of said mat, a flexible and resilient insulating cushion interposed in the space between said sheets, said cushion having means defining a plurality of holes, there being at least one such hole associated with each of said switch elements, means defining at least one conductive member extending into each said hole forming between said sheets a normally open pair of contacts, said mat further having means defining markings on a surface thereof corresponding to the positions of said switch elements, an electronic control circuit adapted to produce an audible sound, said switch elements being connected to said circuit and adapted to close the respective contacts and produce a discrete sound when the mat is stepped on at a position corresponding to one of said markings.

2. The device of claim 1, wherein said insulating cushion being made in one piece extending all over said mat.

3. The device of claim 1, wherein one of said conductive sheets being made in one sheet extending all over said mat.

4. The device of claim 1 in which said conductive members comprise conductive projections carried on at least one of said sheets and extending into said holes.

5. The device of claim 1 in which said conductive members comprise projections formed on each of said sheets and extending toward each other within said holes.

6. The device of claim 1 in which said conductive members comprise discrete conductive elements received in said holes.

7. The device of claim 1 in which each said marking includes a plurality of said switch elements for reliability of operation.

* * * * *